United States Patent [19]

Lee

[11] 4,435,917

[45] Mar. 13, 1984

[54] LIGHTING SYSTEM FOR ROTATABLE TOY

[76] Inventor: William B. Lee, 252 South 800 East, Salt Lake City, Utah 84102

[21] Appl. No.: 373,427

[22] Filed: Apr. 30, 1982

[51] Int. Cl.[3] ..... A63H 33/26

[52] U.S. Cl. ..... 46/228

[58] Field of Search ..... 46/226, 227, 228, 229, 46/61, 74 D; 273/424, 425, 46

[56] References Cited

U.S. PATENT DOCUMENTS 3,162,979 12/1964 Garoogian ..... 46/228

3,812,614 5/1974 Harrington ..... 46/228

*Primary Examiner*—Mickey Yu

*Attorney, Agent, or Firm*—Robert R. Finch

[57] ABSTRACT

There is disclosed an illuminated flying saucer toy is which incandescent lamps are pulsed on and off by an astable multivibrator circuit. The circuit is arranged to pulse at a relatively slow rate when the toy is at rest and at a relatively increased rate when the toy spins at a rate above a predetermined minimum. The increased flash rate is provided through a normally open switch that closes upon rotation of the toy to insert additional resistance into the circuit in parallel with existing resistance thereby to reduce the resistance by which flash interval is determined.

6 Claims, 6 Drawing Figures

LIGHTING SYSTEM FOR ROTATABLE TOY

FIELD AND BACKGROUND OF THE INVENTION

This invention relates generally to lighting systems for rotating toys and in particular to a lighting system particularly adapted for embodiment in the so-called "flying saucer" toy.

The well known flying saucer toy is simply a light weight disc having aerodynamic characteristics enabling it to travel considerable distances when thrown. When thrown in a normal fashion the disc spins during flight. A typical flying saucer toy is disclosed in U.S. Pat. No. 3,359,678. To add interest to use of the saucer and also to enhance location and recovery thereof, lights have been mounted on the saucer, usually at the periphery. Typical of such systems is the chemiluminescent system disclosed in U.S. Pat. No. 4,086,723; the simple on-off battery powered system described in U.S. Pat. No. 3,786,246; or the battery powered flashing light system described in U.S. Pat. No. 3,812,614. The latter patent describes a circuit for a flying saucer toy in which light emitting diodes located on the saucer periphery flash at fixed time intervals. The circuit is designed so the blinks are intense but of short duration. In fact, the current wave form comprises alternate positive and negative spikes that exponentially decay to zero. The flash frequency is adjustable by a potentiometer in the circuit and, once set, remains constant regardless of whether the toy is at rest or in motion. The flash frequency is set at about midpoint of the anticipated range of rotational speed of the toy during flight. Lighting circuits have also been incorporated in spinning tops and include a normally open centrifugal switch that closes when rotation of the top exceeds a predetermined minimum rate.

Although the above described lighted flying saucers are workable they still present some shortcomings. The chemiluminescent system has the basic disadvantage that once actuated it cannot be deactivated hence simply stays on until exhausted. The continuously-on battery operated system can be turned on and off at will, but is just not very interesting. Moreover, it makes a continual draw on the battery. The light emitting diode system partially overcomes the low battery life problem but is not efficient as to light output for given power consumption. Moreover, light emitting diodes are available in only a few colors thus limiting their use as an identifier when a number of players are competing with lighted flying saucers.

SUMMARY OF THE INVENTION

It is the primary object of this invention to provide control circuit and lighting system for use on rotatable toys such as flying saucers that is low in power consumption yet provides blinking lamps to increase interest in play.

Another object is the provision of a circuit of the type described by which when the toy is at rest the lamps flash at a relatively low frequency, when the rotation is above a selected rate a normally open switch closes whereby frequency of lamp flashes increases markedly and when rotation falls below the selected rate the normally open switch re-opens and the lamps flash only at the initial low frequency.

An additional object is the provision of a circuit in which lamps are off when the toy is at rest and blink only when the toy is spinning.

A related object is the provision, in a lighting system of type described, of means by which the output pulses are voltage regulated thus allowing the lamps to be of the incandescent type operating at a voltage which yields high light output for given power consumption.

A still further object of the invention is the provision of replaceable lens or filters covering the lamps thereby facilitating change of the color of the lamp flashes.

The foregoing and probably other objects are achieved by incorporating in a spinning toy, such as a flying saucer, one or more incandescent lamps, desirably, but not necessarily, at or adjacent the saucer rim, a battery, preferably at the central axis of the saucer, and a solid state circuit connecting the battery and lamps, said circuit including an astable multivibrator circuit, a power switch connecting the battery to the circuit to effect flashing of the lamps, and a secondary switch that is normally open but closes upon rotation of the toy faster than a preselected rate and which, upon closing, connects an additional resistance component into the astable multivibrator circuit in parallel with existing resistance in the charge components of the circuit thereby to reduce effective resistance with a consequent decrease in capacitor charge time and thus lamp dark time. In other words the flash interval decreases so the frequency increases, but the flash duration remains unchanged.

The astable multivibrator circuit includes a readily available integrated circuit NE555, a first resistor, a second resistor and a capacitor connected in series to determine the capacitor charge rate (flash interval) and discharge rate (flash duration). Voltage to the lamps is controlled by a transistor and Zener diode and a resistor.

The invention presents a unique external circuit for effecting an increase in pulse or lamp flash rates when the toy is thrown or otherwise spun at a sufficient rate to close the normally open second switch. When this switch is closed it inserts an additional resistance into the circuit in parallel with the existing resistance in the capacitor charge circuit. The result is a net decrease in resistance with a consequential decrease in the capacitor charge time and lamp dark time or interval. In other words, the flash frequency increases, but since the resistance controlling capacitor discharge time is unchanged, the flash duration is unchanged.

For circuit stability and also to enable regulation of flash interval, the additional resistance is provided as two resistors one of which is variable.

The normally open secondary switch may be a centrifugal switch near the saucer perimeter that closes when rotation exceeds a certain preselected rate.

In accordance with the invention instead of a switch closed by centrifugal force, a switch is provided having a flexible conductor with a flat surface and the switch is positioned so the flat surface is presented to air pressure as the toy rotates. The pressure differential thus produced deflects the conductor to close the switch. In accordance with the invention the switch will close whether the toy spins clockwise or counter-clockwise.

Because of the characteristics of the complete circuit of the invention, very little current is required to change the charge time (flash frequency) thus enabling the use of a light inexpensive secondary switch.

Another feature of the invention provides holders so that removable filters or lens of various colors can be inserted over the lamps thus to provide infinite color choices.

The physical components may be mounted in any convenient manner on the saucer to best distribute weight without detracting from the saucer's flight characteristics. The battery which is quite heavy is best placed in the center.

In order that the invention may be better understood and carried into effect, reference is made to the accompanying drawings and description thereof which are offered by way of example only and not in limitation of the invention the scope of which is defined only by the appended claims including equivalents of components embraced therein.

DESCRIPTION OF PREFERRED EMBODIMENT

Figure 1:
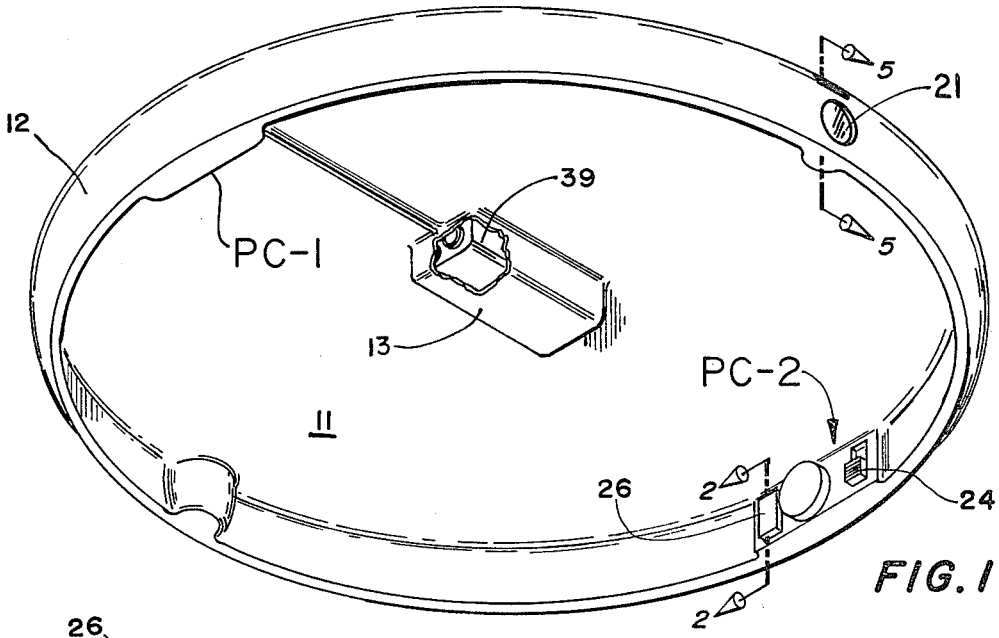
FIG. 1 is a perspective view of a flying saucer toy embodying the invention.

As illustrated in FIG. 1 the flying saucer toy is of usual construction for such devices comprising a domed top portion 11 turning down at its outer edge into a peripheral skirt 12. A central pocket 13 is molded into the center of the top and in which a clamp (not shown) is provided to hold a battery, typically 9 volt, alkaline, that will be connected by a usual clip into the circuit.

Figure 5:
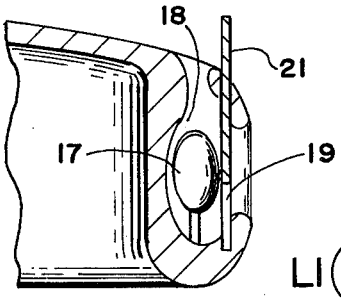
FIG. 5 is a section taken in the plane of line 5—5 of FIG. 1 looking in the direction of arrows 5.

As best illustrated in FIG. 5, tiny incandescent lamps 17 are secured in pockets 18 specially formed in the skirt; and to provide maximum flexibility in color selection for signals or identification, each pocket is provided with grooves 19 for receiving a colored plastic filter or lens 21.

The entire lighting circuit, other than battery and some connecting wires, is located on the inside wall of the skirt 12. In the illustrated embodiment, parts of the circuit have been assembled on two separate printed circuit boards shown in FIG. 1 as components PC-1 and PC-2 mounted on the inside wall of the skirt and connected to each other by suitable conductors.

The circuit is provided with a suitable primary on-off switch 24 and also a normally-open secondary switch 26 both of which are mounted on the inside skirt wall. The latter switch closes in response to rotation of the saucer at a rate above a pre-determined minimum.

Figure 2:
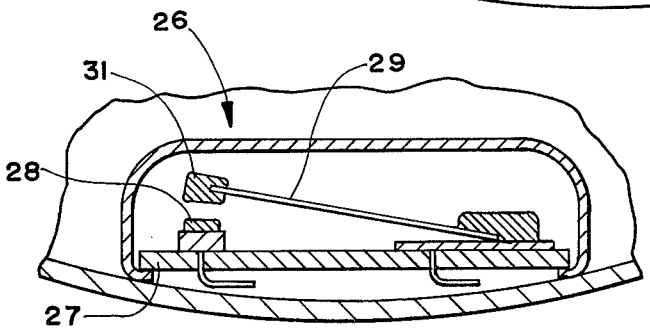
FIG. 2 is a sectional view taken in the plane of line 2—2 of FIG. 1 looking in the direction of arrows 2 and illustrating one form of motion-closed switch.

FIG. 2 illustrates one form of secondary switch that is closed by rotation of the toy. This switch, referred to herein as a centrifugal switch, includes a base 27 of non-conductive material but with a conductive contact point 28. The base is mounted on the inner skirt wall. A conductive spring member 29 with a contact point 31 is separately mounted on the skirt with the contact point 31 in registration, but normally biased out of engagement with the contact point 28 on the base. The contact point 31 and spring 29 are selected so that upon rotation of the saucer the forces generated will overcome the spring bias and force the contact point 31 into engagement with the contact point 28 thus closing the switch. Both contact points are connected in the circuit as discussed hereinafter in connection with the circuit diagram of FIG. 6.

Figure 3:
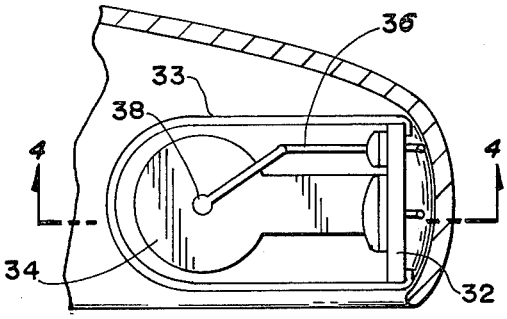
FIG. 3 is a side elevation of a unique form of motion-closed switch that is closed by air pressure differential as the toy and switch rotate.
Figure 4:
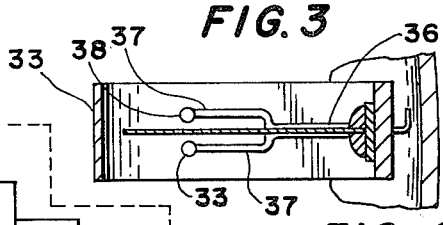
FIG. 4 is a sectional view taken in the plane of line 4—4 of FIG. 3 looking in the direction of arrows 4.

A unique form of motion-closed secondary switch provided in accordance with the invention is illustrated in FIGS. 3 and 4. Although this switch is normally open and is closed by rotation, it is not a centrifugal switch. Instead it closes in response to air pressure differential on its opposite sides as the saucer rotates. The switch comprises a non-conductive base 32 on the inner wall of the skirt 12, a U shaped protective housing 33 extending radially inwardly with the closed part toward the center of the saucer and the plane of the U parallel with the saucer axis. The housing is open on both sides so that when positioned as described saucer rotation in either direction will in effect create an air flow through the U. A paddle-shaped flexible conductor is connected to the base and extends radially inwardly inside the U shaped housing in the path of air flow.

A rigid conductor 36 also extends radially inwardly from the skirt and base 32. The rigid conductor is bifurcated and terminates in prongs 37 spaced on opposite sides of the flexible conductor 34.

If desired, contact points 38 may be provided on the flexible conductor and at the ends of both prongs 37. Both the rigid piece 36 and the flexible center conductor connect by suitable conductors to the circuit. As illustrated, the switch is normally open, but when the saucer rotates, air pressure differential is created between the front and rear faces of the flexible conductor thus bending or deflecting it into contact with a prong of the conductor 36 thereby closing the switch. By providing a paddle that can flex in either direction to contact the rigid conductor, the switch will close regardless of direction of rotation. Thus, it will close whether thrown by a right handed or left handed player.

Figure 6:
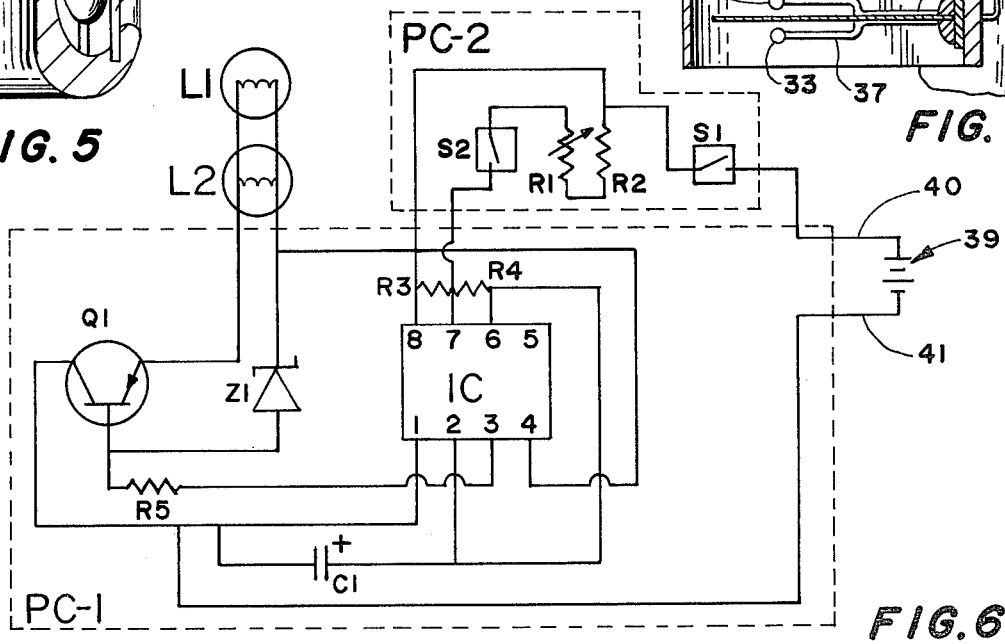
FIG. 6 is a diagram of the electronic circuit embodying the invention.

The electronic circuit of the invention is shown in FIG. 6. As a power source the circuit employs a battery 39, with one conductor 40 connected to the positive battery terminal and another conductor 41 connected to the negative battery terminal. A single-pole single-throw master switch S1 is connected in the positive conductor line. Beyond the master switch, the system includes an astable multivibrator circuit comprised of an integrated circuit chipIC, resistors R3 and R4 and a capacitor C1. The multivibrator circuit pulses at a rate and duration established by the integrated circuit in cooperation with resistors R3 and R4 and capacitor C1. Voltage is maintained by a Zener diode Z1 in combination with a resistor R5. A transistor Q1 is utilized as a driver for supplying current to one or more incandescent lamps L1. The circuit so far described is the one that is operable when the master switch S1 is closed and the toy at rest with the secondary switch S2 open.

According to the invention, a secondary switch S2 along with additional resistance-provided by a variable resistor R1 in series with a resistor R2-are added to the circuit. When the secondary switch S2 closes, the additional resistance co-acts with the existing resistor R3 to function as an external resistor switch for the purpose of reducing the charge time thus reducing the dark interval. The additional resistance (R1 and R2) is connected to the circuit parallel to existing resistor R3 thus decreasing the effective resistance of R3 which in turn decreases the resulting sum of R3 and R4 and provides a consequent decrease in the charge time of capacitor C1, thereby reducing the interval between flashes. The net result is an increase in flash rate, but not in duration of flash. The variable resistor is used to adjust the flash rate to obtain the desired flash frequency.

Due to the high internal impedance of the integrated circuit and its associated components only a very low current drive through the secondary switch S2 is needed to control the frequency and duty cycle of the astable multivibrator. This is an important feature of the invention because it enables the use of a lightweight light-duty secondary switch S2.

A transistor Q1 in the circuit is the current amplifier for output of the integrated circuit IC and, in conjunction with the Zener diode, Z1, forms an emitter-follower voltage regulator which regulates voltage across the lamps.

If it is desired to have the lamps dark when the toy is at rest, the resistor R3 can be omitted. Alternatively, the resistor R3 can be variable to infinity or open to achieve the same result. Nevertheless, even with R3 out of the circuit, when the secondary switch closes, resistors R1 and R2 will combine in series with R4 to initiate flashing.

The circuit components may be spaced around the flying saucer as needed to achieve proper weight distribution. In one actual embodiment of the invention, the circuit, except for the lamps, battery and conductors was put on two separate circuit boards as indicated by dash lines labeled PC1 and PC2 in FIG. 6. The circuit boards were mounted on the saucer as indicated in FIG. 1. The conductors and lamps were positioned as needed to complete the circuit.

In a test model the actual components employed were:

Lamps, L1-General Instrument #CM1738
Battery-9 Volt alkaline
Resistors All ¼ Watt, 5%. Values in Ohms
R1-100K variable
R2-240
R3-1 M
R4 8.2K.
R5 330.
Q1 Transistor 2N2907
Z1 Zener diode IN5234 (6.2 Volt)
1C Integrated circuit NE555
S1 Single pole single throw slide switch
S2 Secondary switch-biased normally open
C1 One microfarad, 16 V electrolytic The power switch 24 was a simple single-pole single-throw slide switch. The acceleration or secondary switch S2 was of the type shown in FIG. 2 in which the switch is biased by a spring lever to be normally open but closes when the centrifugal force generated by rotation of the saucer overcomes the spring bias and presses the contacts together.

In the arrangement described, with the power switch closed and the toy at rest the "on" or incandescent time was about 1/30th of a second while the "off" or dark time interval was about one second. In other words, the unit flashed every second. When the disc was spinning at a sufficient rate to close the secondary switch the dark or off time interval decreased to the range of 1/5 to 1/30 of a second, but the "on" time remained the same. In the model, about two revolutions per second was the minimum required to close the secondary switch.

At spin rates above the minimum the switch remained closed and the more frequent flashes continued. When the spin rate dropped below minimum, the switch opened and the interval between flashes reverted to about one second.

The flash rate can be changed by the variable resistor R1; and the spin rate required for closing the secondary switch can be varied in several known ways such as saucer diameter change, change of switch location, increase or decrease of mass on the switch leaf, more or less flexibility of the spring leaf and the like.

Although the invention has been described in connection with a toy flying saucer, it is obvious that it may be used with tops or other rotating devices.

The entire circuitry of the IC NE555 has not been illustrated in detail because such an explanation is unnecessary to an understanding of the invention. However, all details of the IC can be derived by reference to pages 9–29 through 9–34 of the Linear Data Book 1980, by National Semiconductor Corp. where on page 9–32 an astable multivibrator circuit like the one referred to herein is described. Such publication is incorporated herein by reference.

It will be appreciated that the entire circuit is especially adapted to the use of incandescent lamps operating at a voltage which yields high light output for given power consumption. This is achieved by connecting the astable multivibrator circuit output through a fourth resistor R5 to the base of an emitter follower circuit and to a zener diode which is in turn connected to the positive or negative voltage supply rails. This is all shown in FIG. 6.

I claim:

1. In a toy of the type having a body rotatable about a central axis and at least one lamp, a battery and associated circuit to light said lamp, the improved lighting system which comprises a solid state astable multivibrator circuit adapted to generate pulses to light said lamp for a predetermined on-time at predetermined intervals said circuit including a first resistor, a second resistor and a capacitor arranged in series so that said second resistor and capacitor determine said on-time of said lamp and said first resistor, said second resistor and said capacitor in series determine said interval; a resistive switch interposed in said circuit in parallel with said first resistor, said resistive switch including a third resistor and a normally open switch arranged so that when said normally open switch is closed said first resistor and said third resistor are in parallel to each other and are each in series with said second resistor and said capacitor, and said normally open switch includes means to close said switch in response to rotation of said toy about its central axis faster than a predetermined rate.

2. A lighting system circuit according to claim 1 in which said means on said switch responsive to rotation of said toy comprises a flexible conductor biased in spaced apart relationship to a fixed conductor and responsive to centrifugal force to bend against said bias into contact with said fixed conductor.

3. A lighting system circuit according to claim 1 in which said normally open switch includes a rigid bifurcated first conductor arranged radially of the axis of the toy and a flexible paddle-shaped second conductor positioned between the prongs of said rigid conductor and arranged so that the plane of said flexible paddle-shaped conductor lies in a plane with the axis of the toy whereby upon rotation of said toy air pressure differential created between opposite sides of the paddle deflect said flexible conductor into contact with said rigid conductor to close said normally-open switch.

4. A rotatable toy according to claim 1 in which the body of said toy comprises a disc having a downturned peripheral skirt, the components of said circuit including said lamps are secured to said skirt, said lamps being exposed for viewing from the outside of said skirt, and a removalbe filter is provided on said skirt to cover each of said lamps.

5. The circuit according to preceding claim 1 in which said third resistor is selectively variable to enable adjustment of said predetermined interval.

6. A lighting system circuit according to claim 1 in which the output from said astable multivibrator circuit is connected through a fourth resistor to the base of an emitter follower circuit and a Zener diode which is in turn connected to either the positive or negative voltage supply conductor of the circuit so that the output voltage of said emitter follower circuit powering said lamps is limited by said Zener diode.

* * * * *